US010184328B1

(12) United States Patent
Holleman

(10) Patent No.: US 10,184,328 B1
(45) Date of Patent: Jan. 22, 2019

(54) SAND DIVERTING VALVE ROD GUIDE

(71) Applicant: Richard Holleman, Kilgore, TX (US)

(72) Inventor: Richard Holleman, Kilgore, TX (US)

( * ) Notice: Subject to any disclaimer, the term of this patent is extended or adjusted under 35 U.S.C. 154(b) by 503 days.

(21) Appl. No.: 14/805,305

(22) Filed: Jul. 21, 2015

(51) Int. Cl.
*E21B 43/12* (2006.01)
*F04B 47/12* (2006.01)

(52) U.S. Cl.
CPC ..... *E21B 43/121* (2013.01); *F04B 47/12* (2013.01)

(58) Field of Classification Search
CPC ..... E21B 43/121; F04B 47/02; F04B 47/12
See application file for complete search history.

(56) References Cited

U.S. PATENT DOCUMENTS 1,832,323 A 5/1929 Rigby
2,590,245 A * 3/1952 Harbison ..... F04B 53/16 166/105.4
4,629,402 A 12/1986 Marshala
6,966,248 B2 11/2005 Mahoney
7,686,598 B2 3/2010 Williams
7,909,589 B2 3/2011 Williams
8,360,756 B2 1/2013 Ford
8,535,024 B2 9/2013 Conyers et al.
2004/0018101 A1 1/2004 Mahoney
2010/0108150 A1 5/2010 Ford
2013/0140247 A1 6/2013 Ford

OTHER PUBLICATIONS

Pumpjack; Wikipedia; http://en.wikipedia.org/wiki/Pumpjack#Down-hole; Sep. 11, 2014.
Diaz; Sucker Rod Pump; http://web.mit.edu/2.972/www/reports/sucker_rod_pump/sucker_rod_pump.html; Sep. 11, 2014.
PPI; Pump Accessories; primepump.ca/pump.html; saved Mar. 7, 2011.
Russell Stevens et al; Protecting your investment in sucker rods; Part 3: Well Optimization; Nov.-Dec. 2005.

* cited by examiner

*Primary Examiner* — Giovanna C. Wright
(74) *Attorney, Agent, or Firm* — CARR Law Firm PLLC

(57) ABSTRACT

The present invention provides a valve rod guide which acts as a sand diverter for pushing or expelling sand to the outside of the pump, thereby reducing sand that otherwise have settled in a down-hole pump.

10 Claims, 4 Drawing Sheets

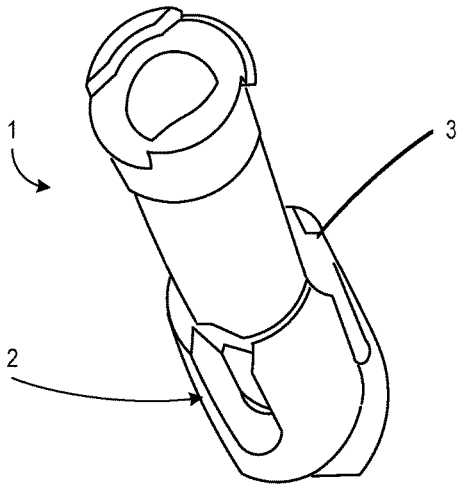
*PRIOR ART*
STANDARD VALVE ROD GUIDE
*FIG. 1*
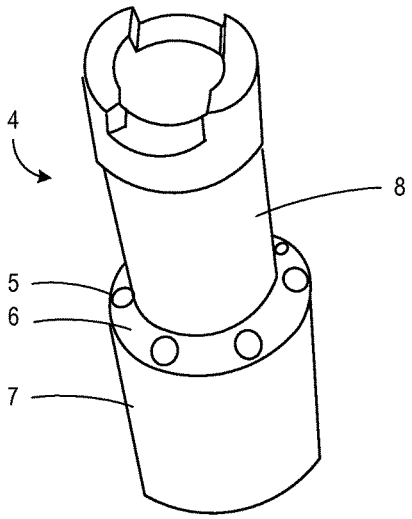
*PRIOR ART*
VERTICAL PORT VALVE ROD GUIDE
*FIG. 2*
*FIG. 3*
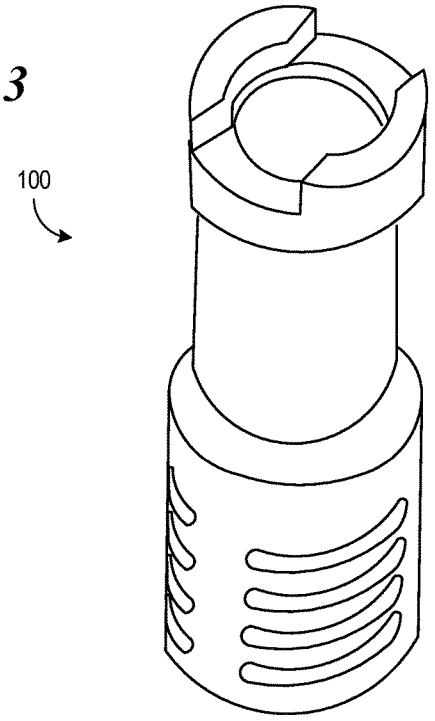
SAND DIVERTER VALVE ROD GUIDE

SAND DIVERTING VALVE ROD GUIDE

BACKGROUND OF THE INVENTION

Field of the Invention

The present invention relates to valve rod guides for down-hole pumps and, more particularly, to a specialty valve rod guide acting as a sand diverter for a down-hole pump.

Description of the Related Art

After years in the down-hole pump industry, many down-hole pumps have been virtually destroyed as a result of sand accumulation. These pumps had been used in a variety applications in the oil and gas industry, for example. The damage to the pumps was most apparent as scoring and grooving of both the plunger and the barrel.

Certain commonly-used valve rod guides are shown, for example, in FIG. 1, showing a standard valve rod guide 1, and in FIG. 2, showing a vertical-port valve rod guide 4. Referring to FIG. 1, the standard valve rod 1 has vertically-oriented ports 2 which are open at the tops 3 thereof. Referring to FIG. 2, the vertical-port valve rod guide 4 has vertically-oriented ports 5 formed in an upwardly-facing surface 6 located between a lower portion 7 and a middle portion 8 of the vertical port valve rod guide 4. These valve rod guides, and others of their kind, may perform the function of expelling solid material, such as sand, for example, from their respective ports, however none of the valve rod guides shown may prevent solid material, such as sand, for example, from re-entering the barrel via the ports. The presence of such solid material in the barrel is known to cause scoring and grooving of both the plunger and the barrel.

SUMMARY OF THE INVENTION

The present invention provides a valve rod guide which acts as a sand diverter for pushing or expelling sand to the outside of the pump.

BRIEF DESCRIPTION OF THE DRAWINGS

For a more complete understanding of the present invention and the advantages thereof, reference is now made to the following Detailed Description taken in conjunction with the accompanying drawings, in which:

FIG. 1-2 are a perspective views of prior art valve rod guides;

FIG. 3 is a perspective view of a sand-diverting valve rod guide according to an aspect of the invention;

DETAILED DESCRIPTION

In the following discussion, numerous specific details are set forth to provide a thorough understanding of the present invention. However, those skilled in the art will appreciate that the present invention may be practiced without such specific details. In other instances, specific mechanical details, and the like, have been omitted inasmuch as such details are not considered necessary to obtain a complete understanding of the present invention, and are considered to be within the understanding of persons of ordinary skill in the relevant art.

Turning now to FIG. 3, a "sand diverter" valve rod guide 100 may be designed to redirect sand to the outside of a down-hole pump with the intent to deflect sand that may otherwise accumulate and lodge between a plunger and a barrel of the down-hole pump. The operation of a plunger and barrel in a down-hole pump is considered to be within the understanding of persons of ordinary skill this field of art, and is shown, for example, in FIG. 4 of U.S. Pat. No. 6,966,246 to Mahoney, the disclosure of which is hereby incorporated by reference.

Figure 4:
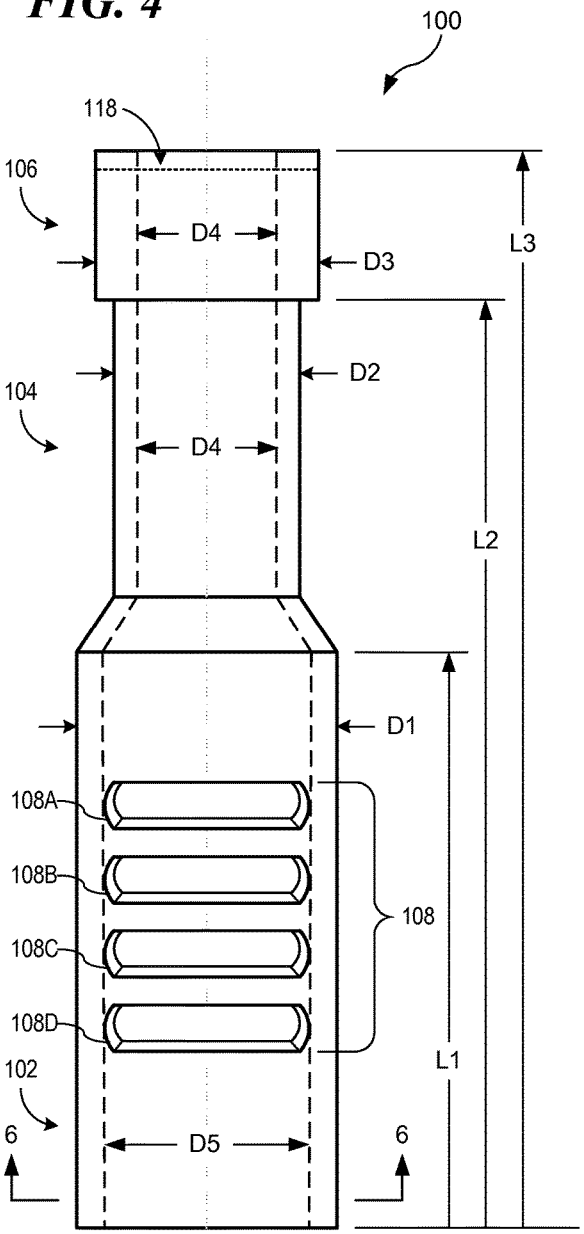
FIG. 4 is an orthographic front view of a sand-diverting valve rod guide.

Turning now to FIG. 4, the reference numeral 100 generally indicates a sand-diverting valve rod guide according to one aspect of the present invention. The valve rod guide may be a generally cylindrical article which, in an embodiment, may have different dimensions, such outer diameter, inner diameter, and the like, for example, in different portions thereof, and may be machined from a rod of steel or other suitable material, the understanding of which is considered to be within that of persons of ordinary skill this field of art. The valve rod guide 100 may have three portions: a first portion 102 which may be threaded for coupling to a down-hole pump barrel; a second portion 104 for guiding a valve rod; and a third portion 106 which may have certain features for coupling to the lower end of a sucker rod string. Each of the three portions 102, 104, and 106 may be considered to have at least two opposing "sides", even though each of the portions may be generally cylindrical. For certain purposes as will be described hereinafter, a generally cylindrical portion of the sand diverter 100 may be considered to have as many "sides" as desired, wherein each "side" may extend through some arc about a circumference of the generally cylindrical portion.

As shown in FIG. 4, the first portion 102 may have a first outer diameter D1, which in an embodiment may be approximately 1.745 inches, for example. The first portion 102 may extend for a length L1, which in an embodiment may be approximately 3.875 inches, for example. The second portion 104 may taper to a second outer diameter D2, which in an embodiment may be approximately 1.360 inches, for example. The second portion may extend to a second length L2, which in an embodiment may be approximately 5.5 inches, for example. The third portion 106, as shown in a top view in FIG. 5 may have a third outer diameter D3, which in an embodiment may be approximately 1.5 inches, for example. The third portion 106 and the second portion 104 may have a first inner diameter D4, which in an embodiment may be approximately 0.95 inches, for example. The third portion may extend to a length L3, the overall length of valve rod guide 100, which in an embodiment may be approximately 6.5 inches, for example. The second portion 104 may taper outward to a second, larger inner diameter D5, which in an embodiment may be approximately 1.40 inches, as shown a sectional view in FIG. 6 for example, and which may be maintained throughout the length L1 of first portion 102.

As shown in FIG. 4, the first portion 102 of valve rod guide 100 may have one or more horizontal slots 108A-108D cut or otherwise formed in at least one side of the first portion 102. A second set of one or more horizontal slots

Figure 7:
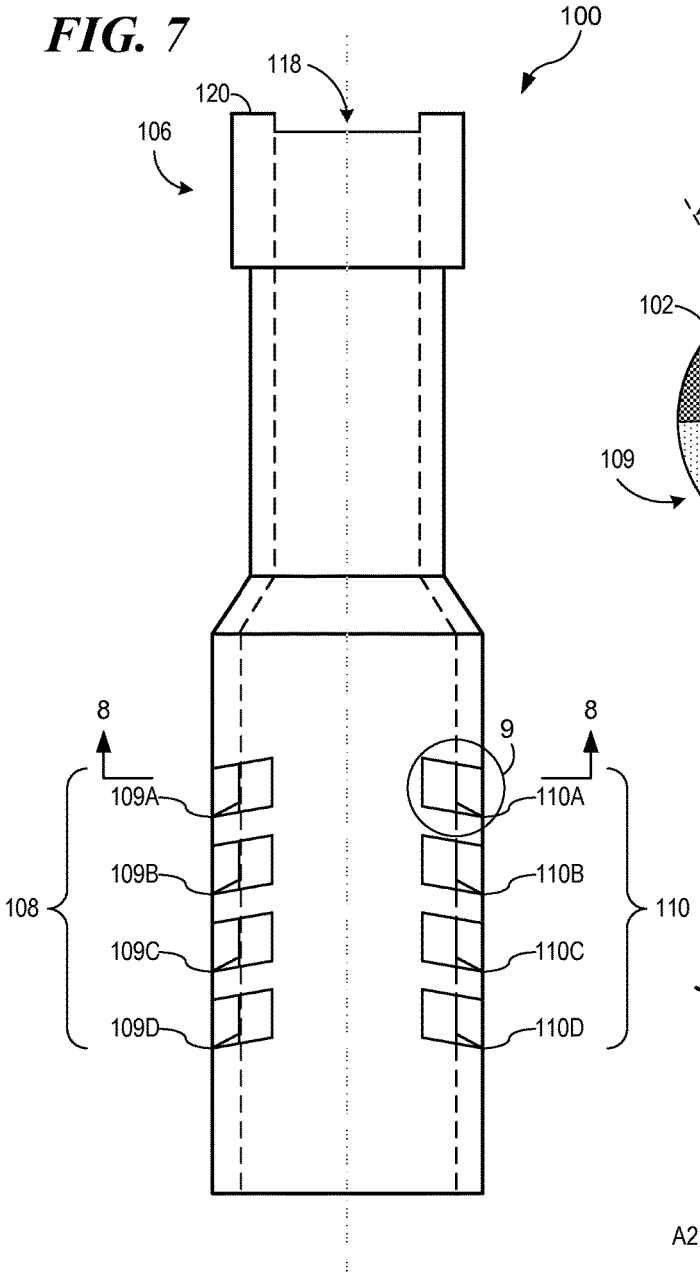
FIG. 7 is an orthographic side view of the valve rod guide.

109A-109D may be cut or otherwise formed in a second side of the first portion 102, as shown in FIG. 7. A third set of horizontal slots 110A-110D may be cut or otherwise formed in a third side of the first portion 102, as shown in FIG. 7. The horizontal slots 108, 109, and 110 may extend through some arc A1 about a circumference of the first portion 102, and may be cut or otherwise formed at some angle to the horizontal, as shown.

Figure 8:
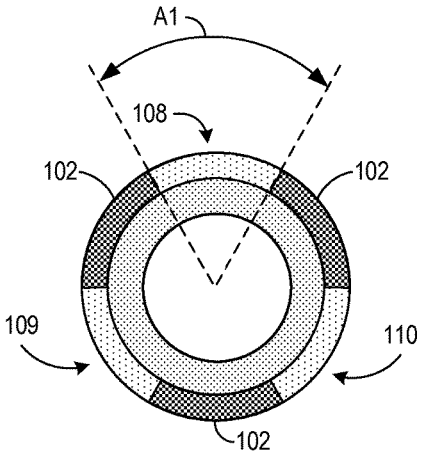
FIG. 8 is a sectional view taken along the lines 8-8 in FIG. 7.

Turning now to FIG. 7, the valve rod guide 100, as shown from one side compared to FIG. 1, may have one or more horizontal slots 108A-108D cut or otherwise formed in at least one side of the first portion 102. A second set of one or more horizontal slots 109A-109D may be cut or otherwise formed in a second side of the first portion 102. A third set of one or more horizontal slots 110A-110D may be cut or otherwise formed in a third side of the first portion 102. As shown in FIG. 8, the horizontal slots 108, 109, and 110 may extend through an arc A1 around a circumference of the first portion 102. In an embodiment, angle of arc A1 may be in the range of 55 to 65 degrees, or approximately 60 degrees, for example. In the embodiment shown, the valve rod guide 100 may have four horizontal slots 108A-108D cut or otherwise formed vertically spaced in a first side of first portion 102, and may have four horizontal slots 109A-109D formed vertically spaced in the second side of first portion 102, and may have four horizontal slots 110A-110D formed vertically spaced in the third side of first portion 102. It should be understood that more or fewer horizontal slots may be cut or otherwise formed in the sides of the first portion 102. For example, one embodiment may have one slot 108A on a first side, one slot 109A on the second side, and one slot 110A on the third side of first portion 102. In another embodiment, there may also be three additional slots 108B-108D on the first side, spaced apart vertically from each other as shown in FIG. 4, and there may also be three additional slots 109B-108D on the second side, spaced apart vertically from each other as shown in FIG. 7, and there may be three additional slots 110B-110D on the third side, spaced apart vertically from each other as shown in FIG. 7. The slots 108, 109, and 110, or the sets of slots 108A-D, 109A-D, and 110A-D, may be evenly spaced from each other around the outer surface of portion 102, as shown in this embodiment, however the slots may be arranged with any desired spacing, such as random, irregular, or patterned spacing, around the outer surface of portion 102. It should be noted that the number of slots 108-110 on each side do not have to be the same, nor is it necessary for the slots 108-110 to be vertically aligned as shown. The slots 108-110 need not be the same length, and the angle of the arc A1 may be different from one slot 108-110 to another.

Figure 9:
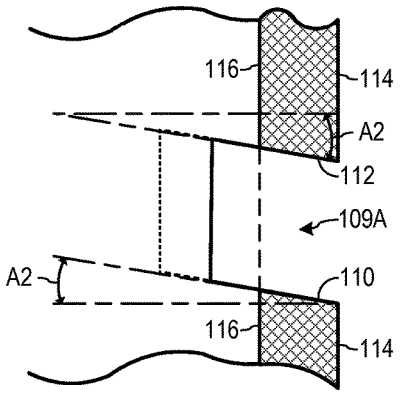
FIG. 9 is a detail, sectional view of the portion indicated within circle 9 as shown in FIG. 7.

Turning now to FIG. 9, each of the slots 108A-108D, 109A-109D, and 110A-110D may be cut or otherwise formed at some angle to the horizontal, as shown with respect to slot 110A, for example. A lower surface 111 of the slot 110A may but cut or otherwise formed at an angle A2 with respect to the horizontal, such that the surface 111 slopes upwards from the outer surface 114 of the valve rod guide 100 towards the inner surface 116 of the valve rod guide 100. An upper surface 112 of the slot 110A may but cut or otherwise formed at an angle A2 with respect to the horizontal, such that the surface 112 slopes upwards from the outer surface 114 of the valve rod guide 100 towards the inner surface 116 of the valve rod guide 100. In an embodiment, the angle A2 may be approximately three degrees, for example. In an embodiment, each of the slots 108A-108D, 109A-109D, and 110A-110D may be cut or otherwise formed sloping at the same angle A2. In other embodiments, the slots may be cut or otherwise formed sloping at different angles. It should be noted that it is not necessary for each of the slots to slope at the same angle A2. The angle A2 may be any value between zero degrees to the horizontal and approximately 10 degrees downward from the horizontal. The angle A2 may preferably be a value between zero degrees to the horizontal and approximately five degrees downward from the horizontal.

Figure 5:
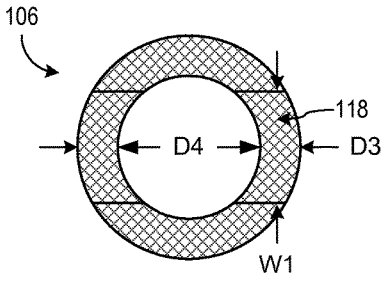
FIG. 5 is an orthographic top view of the valve rod guide.
Figure 6:
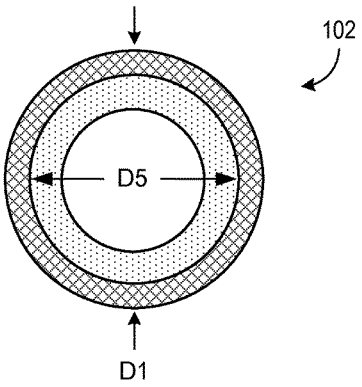
FIG. 6 is an orthographic bottom view of the valve rod guide.

Referring again to FIG. 7, a notch 118 may be cut or otherwise formed across a top surface 120 of third portion 106 of the valve rod guide 100 for receiving a bushing provided at the bottom of a string of sucker rods. The notch 118 may have a width W1 which, in an embodiment, may be approximately 0.875 inch, for example. The notch 118 may extend across the top of the third, upper portion 106 for the length of diameter D3, as shown in FIG. 5.

Figure 10:
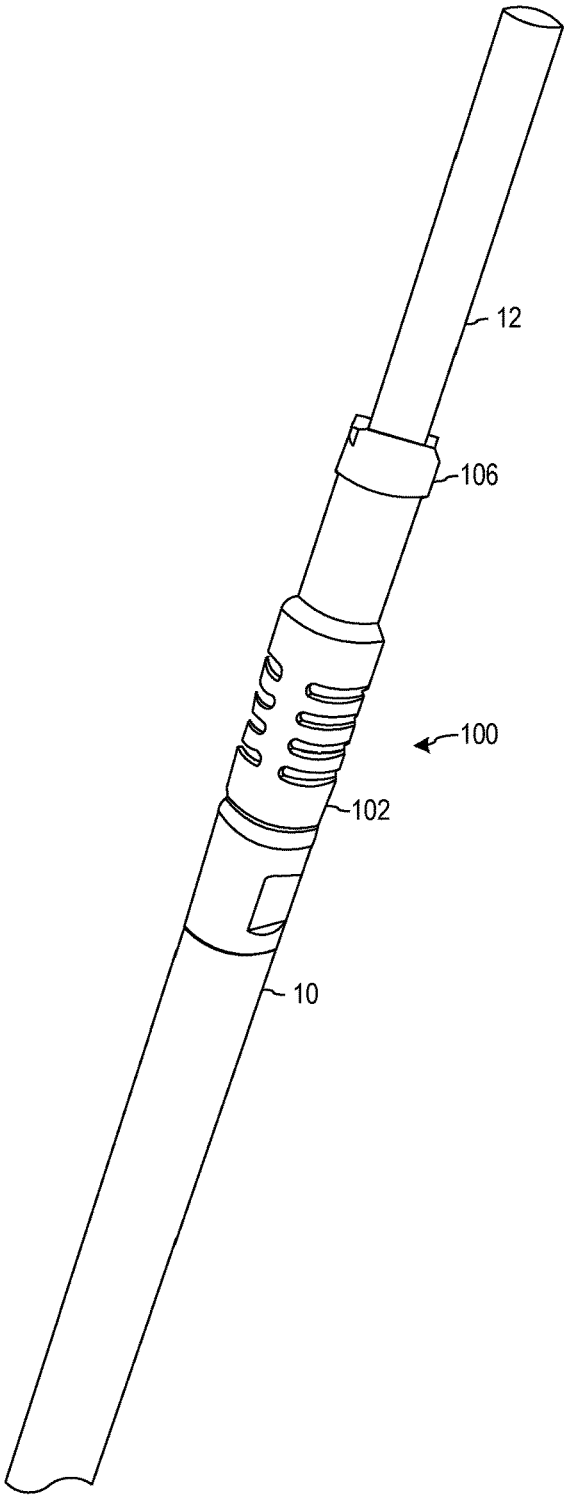
FIG. 10 is a perspective view of a valve rod guide coupled to a barrel for a down-hole pump.

In operation, and as shown in FIG. 10, the first, lower portion 102 of the valve rod guide 100 may be coupled to the top end of a barrel 10 of a down-hole pump, with a valve rod 12 passing through the valve rod guide 100, and the third, upper portion 106 may be coupled to a bushing at the bottom of a string of sucker rods. The inside diameter D5 may be greater than a diameter of a valve rod to provide an annular space around the valve rod so that liquid or solid contaminants, such as sand, for example, can flow out of the slots 108-110. As the string of sucker rods is moved up and down to operate the down-hole pump, sand and other solid materials may be expelled from the sand-diverting valve rod guide 100 through the downward sloping slots 108, 109, and 110 to the outside of the pump, past the barrel and into the tubing annulus, thereby substantially reducing or eliminating sand or other solid materials that otherwise would have settled in the down-hole pump.

The Sand Diverter Valve Rod Guide 100, as shown in FIGS. 4-10 may have horizontal ports opening to the side and angled slightly downward. The downward angle of the ports may re-direct falling sand or other solid material downward and away from the port rather than re-entering the barrel of a down-hole pump.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A valve rod guide for a down-hole pump, comprising:

a generally cylindrical body comprising a bore;

the bore comprising a first portion further comprising a first inner diameter and a first outer diameter corresponding to the first inner diameter;

the bore comprising a second portion further comprising a second inner diameter and a second outer diameter corresponding to the second inner diameter;

a first horizontal slot extending through a first side of the first portion of the cylindrical body, a second horizontal slot extending through a second side of the first portion of the cylindrical body, and a third horizontal slot extending through a third side of the first portion of the cylindrical body;

wherein each of the first horizontal slot, the second horizontal slot, and the third horizontal slot each comprise a passage from the bore to an environment outside the valve rod guide; and a fourth horizontal slot extending through the first side of the first portion of the cylindrical body, wherein the fourth horizontal slot is vertically spaced from the first horizontal slot; and wherein the first horizontal slot and the fourth horizontal slot comprise a first set of horizontal slots.

2. The valve rod guide of claim 1, wherein each of the first horizontal slot, the second horizontal slot, and the third horizontal slot comprises a lower surface further comprising a downward slope towards an external opening of each horizontal slot.

3. The valve rod guide of claim 2, wherein the slope comprises an angle in the range of zero to ten degrees downward from the horizontal, inclusively.

4. The valve rod guide of claim 2, wherein the slope comprises an angle in the range of zero to five degrees downward from the horizontal, inclusively.

5. The valve rod guide of claim 2, wherein the angle is three degrees.

6. The valve rod guide of claim 1, wherein each of the first horizontal slot, the second horizontal slot, and the third horizontal slot extend through an arc around at least a portion of the circumference of the first portion of the cylindrical body.

7. The valve rod guide of claim 6, wherein the arc is in the range of 55 to 65 degrees.

8. The valve rod guide of claim 7, wherein the arc is 60 degrees.

9. The valve rod guide of claim 1, further comprising:

a second set of a plurality of horizontal slots formed in the second side of the first portion of the cylindrical body comprising the second horizontal slot, wherein the horizontal slots of the second set of horizontal slots are vertically spaced apart from each other.

10. The valve rod guide of claim 1, further comprising:

a third set of a plurality of horizontal slots formed in the third side of the first portion of the cylindrical body comprising the third horizontal slot, wherein the horizontal slots of the third set of horizontal slots are vertically spaced apart from each other.

* * * * *